US006109370A

United States Patent [19]

Gray

[11] Patent Number: 6,109,370

[45] Date of Patent: Aug. 29, 2000

[54] SYSTEM FOR DIRECTIONAL CONTROL OF DRILLING

[75] Inventor: Ian Gray, 48 Marriott Street, Coorparoo, Queensland 4151, Australia

[73] Assignee: Ian Gray

[21] Appl. No.: 09/011,999

[22] PCT Filed: Jun. 25, 1997

[86] PCT No.: PCT/IB97/00962

§ 371 Date: Jan. 20, 1999

§ 102(e) Date: Jan. 20, 1999

[87] PCT Pub. No.: WO97/49889

PCT Pub. Date: Dec. 31, 1997

[30] Foreign Application Priority Data

Jun. 25, 1996 [AU] Australia ..... PO0622

[51] Int. Cl.[7] ..... E21B 7/08

[52] U.S. Cl. ..... 175/61; 175/38; 175/215

[58] Field of Search ..... 175/61, 24, 27, 175/45, 38, 324, 215

[56] References Cited

U.S. PATENT DOCUMENTS

| | | | |
|---|---|---|---|
| 3,746,108 | 7/1973 | Hall | 175/61 |
| 4,163,324 | 8/1979 | Russell et al. | 33/313 |
| 4,596,293 | 6/1986 | Wallussek et al. | 175/27 |
| 4,637,479 | 1/1987 | Leising | 175/26 |
| 4,794,336 | 12/1988 | Marlow et al. | 324/221 |
| 4,796,699 | 1/1989 | Upchurch | 166/250 |
| 4,875,014 | 10/1989 | Roberts et al. | 324/326 |
| 4,875,292 | 10/1989 | Gibson | 33/304 |
| 4,905,774 | 3/1990 | Wittrisch | 175/26 |
| 4,956,921 | 9/1990 | Coles | 33/304 |
| 5,020,608 | 6/1991 | Odén et al. | 175/21 |
| 5,156,222 | 10/1992 | Jurgens et al. | 175/26 |
| 5,220,963 | 6/1993 | Patton | 175/24 |
| 5,230,387 | 7/1993 | Waters et al. | 175/45 |
| 5,314,030 | 5/1994 | Peterson et al. | 175/26 |
| 5,355,960 | 10/1994 | Schultz et al. | 166/374 |
| 5,419,405 | 5/1995 | Patton | 175/27 |
| 5,421,420 | 6/1995 | Malone et al. | 175/61 |
| 5,439,064 | 8/1995 | Patton | 175/24 |
| 5,449,046 | 9/1995 | Kinnan | 175/24 |

FOREIGN PATENT DOCUMENTS

| | | | |
|---|---|---|---|
| 5845180 | 5/1981 | Australia | E21B 47/12 |
| 7327987 | 11/1987 | Australia | E21D 9/10 |
| 7907687 | 4/1988 | Australia | E21B 7/04 |
| 4550396 | 9/1996 | Australia | E21B 44/00 |
| 0429254 | 11/1990 | European Pat. Off. | E21B 7/06 |
| 0774563 | 11/1996 | European Pat. Off. | E21B 7/06 |
| 0775802 | 11/1996 | European Pat. Off. | E21B 7/06 |
| 4016437 | 8/1991 | Germany | E21B 47/02 |
| 2284837 | 6/1995 | United Kingdom | E21B 7/08 |
| 9312318 | 6/1993 | WIPO | E21B 7/04 |
| 9630616 | 10/1996 | WIPO | E21B 4/00 |
| WO9637678 | 11/1996 | WIPO | E21B 7/04 |

*Primary Examiner*—Frank S. Tsay
*Attorney, Agent, or Firm*—Sidley & Austin

[57] ABSTRACT

A drill bit (6) is equipped with one or more fluid jets (7) that are activated during a portion of the rotational movement of the drill bit (6). A processor (41) located with other downhole sensors (33–38), is programmed with parameters defining the desired path of the borehole (8). The sensors (33–38) determine the actual spatial location of the drill bit (6) and provide the processor (41) with corresponding information. The processor (41) compares the actual drilling path to the desired path, and if a correction is required, a switching module (3) allows a pressurized drill fluid to be sequentially switched to selected jets (7) during rotation of the drill bit (6) to thereby erode the formation in a direction toward the desired path. With this arrangement, the problems of directional control by surface-located equipment are overcome.

21 Claims, 10 Drawing Sheets

SYSTEM FOR DIRECTIONAL CONTROL OF DRILLING

BACKGROUND OF THE INVENTION

Directional controlled drilling arises from the early practices of using either a whipstock (wedge) set within a borehole to force a hole to deviate from a known trajectory, or the use of a jetting bit. Both are described in some detail in *Applied Drilling Engineering, Society of Petroleum Engineers Textbook Series*, Vol. 2, Chapter 8, Adam T. Bourgoyne Jr., Keith K. Millheim, Martin E. Chenevert & F. S. Young, Jr., 1991. The jetting system typically involves the use of a two-cone roller bit with a single stabilizer and a large jetting bit. When a directional adjustment is required, the drilling is interrupted and the large jet is held in the direction in which the deviation is required so that the jet erodes preferentially in that direction. Rotary drilling can resume after the desired directional change has been effected.

More recently most directional drilling has been undertaken by the use of down-hole mud motors. Turbine and positive displacement motors have been used with the latter being in more common use. Down-hole motors operate by converting energy extracted from the drilling fluid forced down the drill string and through the motor. This energy is converted into rotary motion which is used to rotate a drill bit that cuts the rock ahead of the tool. Directional change is effected by the use of a bottom hole assembly which includes a bent housing either behind or in front of the motor so that the bit does not drill straight ahead, but rather drills ahead and off to the side. This bottom hole assembly may be supported within the borehole by a series of stabilizers which assist the angle building capability of the assembly.

The bottom hole assembly so described tends to build an angle rather than drill straight ahead. Such a tendency can be halted in some drilling systems by rotating the entire drill string and bottom hole assembly so that on average the system drills straight ahead. A more common practice is to undertake repeated directional changes to the borehole trajectory by turning the rod string and hence the tool face angle. Alternatively, as is the case in coiled tubing drilling where the drill string cannot be rotated, the tool face is adjusted by incremental moves associated with fluid pressure pulses which relocate the tool at varying tool face angles. By changing the direction at which the bottom hole assembly tends to build an angle, many changes to the trajectory can be achieved. The borehole is seldom aligned in its intended direction but follows a snaking path about the planned direction. One of the consequences of this system of drilling is that the drill string is, by reason of the many changes in direction of the borehole, subject to much higher friction and stress levels. This is described in more detail in the publication *Optimisation of Long Hole Drilling Equipment, Australian Mineral Industries Research Association, Melbourne*, Ian Gray, March 1994. A consequence of the friction and stress is that the length of borehole is limited.

The basis for changing the direction in which drilling assemblies currently drill includes survey information measured near the bit, combined with a knowledge of the total distance drilled, and knowledge of the formation. The survey information normally provides information on the direction tangential to the survey tool located in the drill rods within the borehole. This information can be integrated with respect to the linear dimension of the borehole to arrive at the coordinates for the borehole. The formation position is either detected by prior drilling and geophysics or by geosteering equipment. The latter may comprise geophysical and drilling sensors to detect the nature of the material which is being drilled, or which are located at some distance from the drill string. The nature of the material being drilled is most likely to be detected using a torque and thrust sensor within the drill string, short focused gamma-gamma probes or resistivity probes. Alternatively, formation types may be detected at a greater distance by long spaced resistivity tools. On the basis of the information about the formation, the drilling direction is adjusted to keep it to near an optimal path.

The logical process of such adjustments is for the drilling to proceed upon an initial direction with an estimated rate of directional change. After some drilling, survey and/or geosteering information is obtained from down-hole sensors and is then transmitted upwardly to the borehole collar or wellhead. This transmission may be by withdrawal of the survey tool containing the information by wireline, by transmission up a cable or by using pressure pulses developed in the drilling fluid by solenoid or other valves which operate to partially restrict drilling fluid flow through a mud pulser section of the geosteering tool. An operator then interprets such information and adjusts the trajectory of the borehole accordingly. Normally, this would be achieved by changing the tool face angle and then continue drilling. This process is interactive, with the system being critically dependent on information flow from the down-hole tools to the operator. It is also highly dependent on the ability of the operator to interpret the information and accurately adjust the tool face angle accordingly. This is not a simple exercise when the likelihood exists for long drill strings to wind up several rotations between the bottom hole assembly and the drill rig at the surface.

An alternative to positive displacement motors and turbines for directional drilling is the use of fluid jets to erode a potential path. A well established system for the use of this equipment has been described above. There has also been a significant amount of interest in alternative drilling strategies using fluid jets to do all the cutting or to use them to assist modified conventional rotary drill bits. This work is well summarized in the publication entitled *Water Jet/Jet Assisted Cutting and Drilling, IEA Coal Research, London*, Peter A. Wood, 1987. With this technique it can be seen that fluid jets can be used to effectively cut coal and some rocks by impact and the action of high pressure fluid in the cracks.

The publication entitled *Development of a High Pressure Waterjet Drilling System for Coalseams*, thesis submitted in partial fulfillment for the degree of Masters of Engineering Science, Department of Mining and Metallurgical Engineering, University of Queensland, by Paul Kennerly, January 1990, describes the use of rotating heads producing fluid jets which are driven by reaction to the emitted jet streams. Pressures used in this work were of the order of 500–700 bar. In addition to forward facing cutters there are also rearward facing jets which are called retrojets. These rearward facing jets were introduced originally to supply additional flushing fluid to the borehole. The reactive thrust that they provided however was adequate to draw the EW rod drill string (1 ⅜" outside and ⅞" inside diameter steel tube) into the borehole, and subsequently the steel drill rod string was dispensed with and drilling was accomplished using a flexible assembly. This consisted of a rotating nozzle, retro-jet jet assembly, ten meters of steel pipe followed by a hydraulic hose which was drawn into the borehole as part of the drill string.

The publication entitled *Development of a Coalseam Water Jet Longhole Drill*, a thesis submitted in partial fulfillment for the degree of Doctor of Philosophy, Department of Mining and Metallurgical Engineering, University of Queensland, by Paul Kennerly, July 1994, describes a further development of the fluid jet drilling system. In the final form reported herein, the drilling was accomplished using a rotating nozzle which was rotated by the reaction to angled forward facing jets. Behind these and on the same rotating nozzle were lateral facing reaming jets. This nozzle was contained within a shroud for its protection. Behind the shroud and nozzle either a bent drill sub and retro-jet unit were installed in that order or with the retro-jet unit ahead of the bent sub.

Directional control was achieved as in down-hole motor drilling by changing the tool face angle of the bent drill sub so that drilling would preferentially take place in the direction in which the sub was pointing.

One of the problems associated with pure fluid jet drilling is the comparative ease and difficulty with which soft and hard materials are cut. The Kennerly thesis reports that an acute angle intersection with a stone band within a coal seam led to the hole narrowing until the drilling apparatus jammed in the hole.

The potential exists to overcome this problem by introducing a drill bit with a reaming or cutting capability so that hard materials may be cut and so that the tendency for the drillhole to be deflected by hard and soft boundaries is reduced.

Such bit assisted fluid jet cutting is summarized in the Wood publication (pp 32 & 40). The publication *Water-Jet Assisted Drilling of Small Diameter Rock Bolt Holes, National Energy Research, Development and Demonstration Program*, End of Grant Report No. 598, Department of Resources and Energy, Canberra, Australia, D. A. Clark and T. Sharkey, 1985, describes the effectiveness of fluid jet assistance in reducing bit wear.

More recently the publications, *In-seam Drilling Researchers' Meeting*, CMTE, Brisbane, John Hanes, Apr. 23, 1996, and *Presentation On Water Jet Assisted Rotary Drilling*, Centre for Mining Equipment and Technology, Brisbane, Australia, Paul Dunn, May 23–24, 1996, referred to the use of fluid jet assisted drilling in coal. This described the use of an 80 mm drill bit being used in rotary drilling in a seam through coal with fluid jet assistance at 40 MPa and 20 MPa. The fluid jets appeared to reduce the bit thrust to a negligible level with the higher fluid pressures. The total distance reached was 250 m.

Another application of fluid jet drilling is described in the publication *Data Acquisition, and Control While Drilling With Horizontal Water-Jet Drilling Systems*, International Technical Meeting by the Petroleum Society of CIM, Calgary, Canada, Paper No. CIM/SPE 90-127, Wade Dickinson et al., Jun. 10–13, 1990, and in *The Ultrashort-Radius Radial System, SPE Drilling Engineering*, SPE Paper No. 14804, September 1989, Wade Dickinson et al., 1989. In these papers reference is made to the use of fluid jets to drill directionally controlled boreholes. The ultrashort-radius system employed the use of side thruster fluid jets to change the direction of the main fluid jet used to drill the hole. The larger system employed the use of a 4.5 inch diameter drilling system which uses a module that seats into the inner end of the drill string. This module is held on a wireline and contains several obliquely angled nozzles designed to erode in preferential paths. In both of these systems the directional control jets are operated by a wireline from the surface through the use of solenoid valves. Both systems refer to fluid pressures of 690 bar.

Directional control has been achieved in drilling without control from the surface. Deutsche Montan Technologie (DMT) described in the *Automatic Directional Drilling System ZBE* 3000, *Deutshe Montan Technologie*, (Internal technical publication), that a system was produced which uses rotary drilling to advance a borehole. Behind the bit was installed an electronic package which senses whether the borehole is out of vertical alignment. This controls pistons which press on the borehole annulus, forcing the drill string back into line.

A device similar in concept to that of DMT is a vertical drilling guidance system, but using a down-hole mud motor is described in *Offshore Application of a Novel Technology for Drilling Vertical Boreholes, SPE Drilling & Completions*, SPE Paper No. 28724, P. E. Foster and A. Aitken, March 1996.

Another application of directional drilling in which control decisions are made in the borehole is sketchily described in *Automated Guidance Systems for Directional Drilling and Coiled Tubing Drilling*, presented to the 1st European Coiled Tubing Roundtable, Aberdeen, Andrew Tugwell, Oct. 18–19, 1994. This system developed by Cambridge Radiation Technology uses some directional sensor/geosteering sensor technology to discern deviations from the planned well path. Corrections in direction are made by rotating a joint above the motor using a hydraulic servo system. The paper is somewhat confusing in that it also refers to a multi-cable system extended to the surface with control being conducted at the surface.

Differential stacking is a factor which influences all drilling where the mud pressure exceeds the formation pressure and particularly in cases where the drill string is not rotated or vibrated.

SUMMARY OF THE INVENTION

According to the present invention, in one aspect, the invention relates to the down-hole sensing, computing and control technique as applicable in general to drilling.

In another aspect, the invention relates to the use of a control technique to directionally control the drilling of boreholes using down-hole mud motors.

In yet another aspect, the invention relates to the use of the fluid jet drilling equipment (which term is used herein to include fluid jet drilling equipment and fluid jet assisted rotary drilling equipment) that is provided with a means by which it can be directionally controlled during the drilling process by means of fluid jet switching. Such jet switching is controlled by a down-hole sensing, computing and controlling apparatus. The sensing, computing and control apparatus preferably comprises a sequence of modules contained in a bottom hole assembly.

The first of these modules is a geosteering sensor array which detects the azimuth and inclination of the borehole. It accomplishes this by the use of flux gate magnetometers, accelerometers, gyroscopes or other devices typically used in borehole surveying. Integrating this information with respect to the measured depth (length, otherwise abbreviated to MD) of the borehole permits the borehole position to be determined by integration. This information can be directly compared with the designed trajectory, and corrections can be calculated to bring the actual trajectory into correspondence to the desired designed trajectory. Alternatively, other geophysical sensing probes may be incorporated into the geosteering sensor and the actual output of these compared with the expected outputs. Corrections to trajectory may be based on the combined geophysical and geometric information. Such a module would be expected to contain sensors, analogue to digital converters and a microprocessor.

By placing most or all of the logic for making drilling trajectory corrections within the down-hole system, the need for excessive up and down-hole communication can be avoided.

Additional information that may be required for such logical operations, such as information on the measured depth (MD) of the borehole, could be readily transmitted from the surface to the geosteering tool, for instance by mud pulse telemetry. Mud pulse telemetry from the surface can also be used to transmit other information down the borehole such as "search down" or "search up" to locate a formation with specific geophysical responses. The down-hole assembly may also use mud pulse telemetry to transmit up hole such information as is obtained from the geophysical sensors. The means of communication along the drill string is not limited to mud pulse telemetry but may include electronic cables, fibre optic links or electromagnetic waves.

The purpose of the second module is to receive the information on the required corrections to the borehole trajectory and to implement the corrections.

In the case of a down-hole mud motor, the directional change required can be implemented by automating the change of the tool face angle down the borehole. Preferably this can be achieved by the use of a clutch assembly placed in the bottom hole assembly which filly or partially de-couples the down-hole motor from the main rod string so that the tool face angle of the bottom hole assembly changes as a result of the reactive torque of the motor acting through the bit. The time period and frequency of the tool face angle changes are controlled through the down-hole logic and switching circuits. Alternatively, although less suitably, this can be achieved though the adjustment of the height of stabilizer pads to deflect the bottom hole assembly.

In the case of fluid jet drilling, directional control can be achieved by either changing the effective direction of fluid jet erosion or by the entire down-hole assembly by selective operation of rearward or sideways oriented thruster jets. The latter is similar in concept to the changing of the trajectory of a rocket by firing specific rocket nozzles placed around the main jet.

In the case of a nonrotating down-hole assembly, the jets can be changed comparatively slowly, and a device such as a solenoid valve can be used to switch the jet flow. Down-hole orientation and tool face angle can be obtained from a conventional survey system contained in the geosteering module. Where faster switching is required, such as in the case of rotary drilling, it is necessary to determine during drill rotation the angular position of the jets and to switch a fluid stream through them fast enough to direct the fluid at the portion of the borehole that needs to be preferentially eroded to change borehole trajectory.

To accomplish this, the orientation of the down-hole assembly during rotation (tool face angle) needs to be determined rapidly during all portions of the drill rod rotation. In one preferred form the orientation is determined electronically by a technique such as measuring the output of a coil placed within, and perpendicularly aligned to, the down-hole assembly. The sinusoidal pulses so produced as the coil cuts the earths magnetic field will define the tool face angle, thus defining the orientation of the tool face and also providing information on rotational speed.

Using this jet orientation information it is possible to switch fluid to the jets and direct the switched fluid stream at the appropriate surfaces of the borehole so as to erode a directionally controlled pathway. As rotary drilling is typically carried out at 150 to 800 RPM and the switching speed needs to be twice this rate to erode only one side of the borehole, this will correspond to switching speeds of at least 5 to 27 Hz. To switch jets at up to 70 MPa pressure with flow rates of up to 0.0025 cu.m/sec per jet requires substantial energy. This energy would be difficult to achieve and would certainly use substantially more electrical power than would be conveniently available down-hole if conventional solenoid valves were used. For this reason jet switching using an electro-fluidic switching system is preferred. This could in turn control a mechanical switch if pressure differentials are too high to be switched by fluidics alone. The preferred control circuit in this case is a bi-stable electromagnetically controlled fluid switch which diverts flow around a cascade of wall attachment turbulent flow fluidic amplifiers, which in turn operate a radially balanced spool valve to control high pressure outflows. It should be appreciated to those skilled in the art that several combinations of electro-fluidics control system could be used to achieve the same purpose.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, elements or functions throughout the views, and in which.

DETAILED DESCRIPTION OF THE INVENTION

Figure 1:
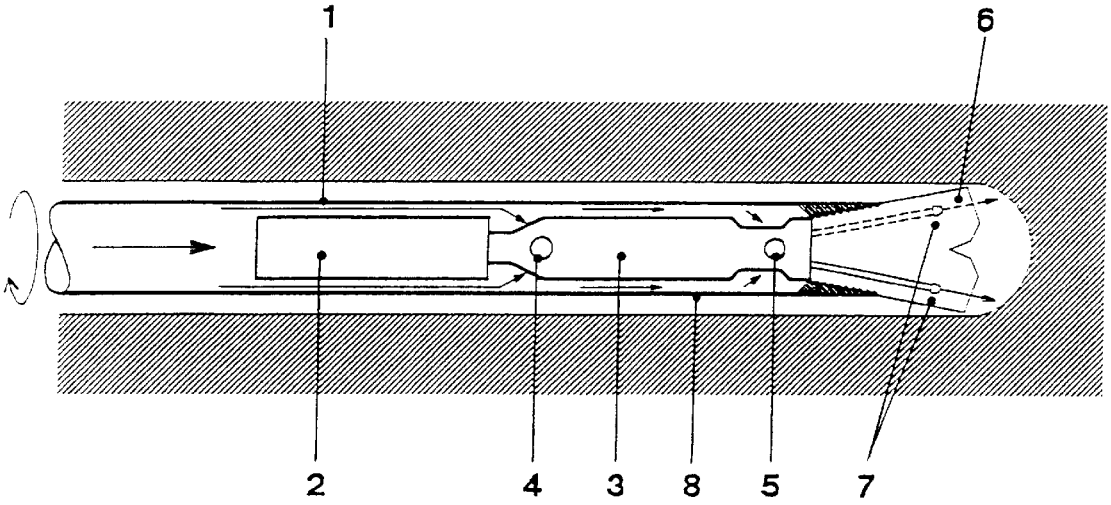
FIG. 1 is a schematic of the concept of the invention applied to fluid jet assisted rotary drilling.

FIG. 1 illustrates the principles and concepts of the invention as applied to fluid jet assisted rotary drilling. In this case the drill rod 1 is connected to a drill bit 6 to form a bottom hole assembly equipped with directional control fluid jets 7 to drill a borehole 8. Other flushing jets (not shown) may also be utilized in conjunction with the drill bit 6. The bit 6 shown is a typical tungsten carbide drag bit which may alternatively be a poly-crystalline diamond cutter bit, a roller bit or other rotational cutting bit including a fluid driven hammer. The directional control fluid jets 7 are pulsed to erode the borehole on the side in which directional course corrections are desired. The fluid pulses are therefore timed to coincide with the rotation of the drill bit 6. The pulsing is controlled by a switching module 3 which can preferably take the form of the electro-fluidic circuit shown in FIG. 4, with or without the control valve shown in FIG. 5. The switching module 3 has inlet ports 4 and 5 to receive pressurized drilling fluid from within the drill string 1 and switch the fluid to the directional control fluid jets 7. This switching action may be between each jet 7 or between one of the jets and other nondirectional fluid jets (not shown). The signals employed to control the timing of the directional control fluid jets 7 are generated in a geosteering module 2.

Figure 2:
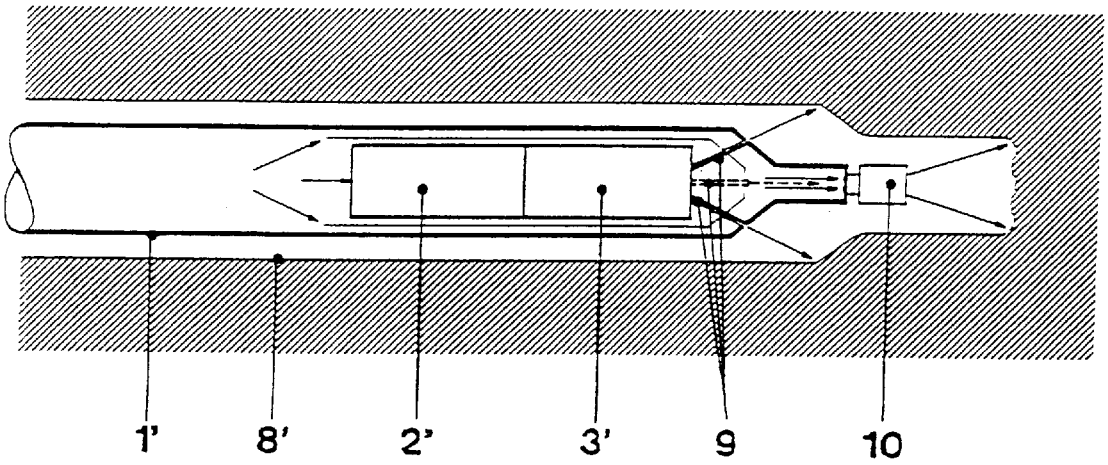
FIG. 2 illustrates the concept of the invention applied to pure fluid jet drilling where rigid drill rods are advanced into the borehole.

FIG. 2 shows an embodiment of the system as applied to pure fluid jet drilling by a bottom hole assembly attached to the front of a conventional drill string or coiled tubing 1'. Here, the main drilling is accomplished by a rotating nozzle 10. Directional control is provided by the directional nozzles 9 which are switched to preferentially erode a desired pathway for the borehole 8'. The control for this operation comes from the geosteering module 2' that controls the switching module 3' which, in turn, controls multiple jets. The switching module 3' preferably takes the form of multiples of the electro-fluidic control shown in FIG. 4, with or without the mechanical valve shown in FIG. 5 and the jet nozzles shown in FIG. 6.

Figure 3:
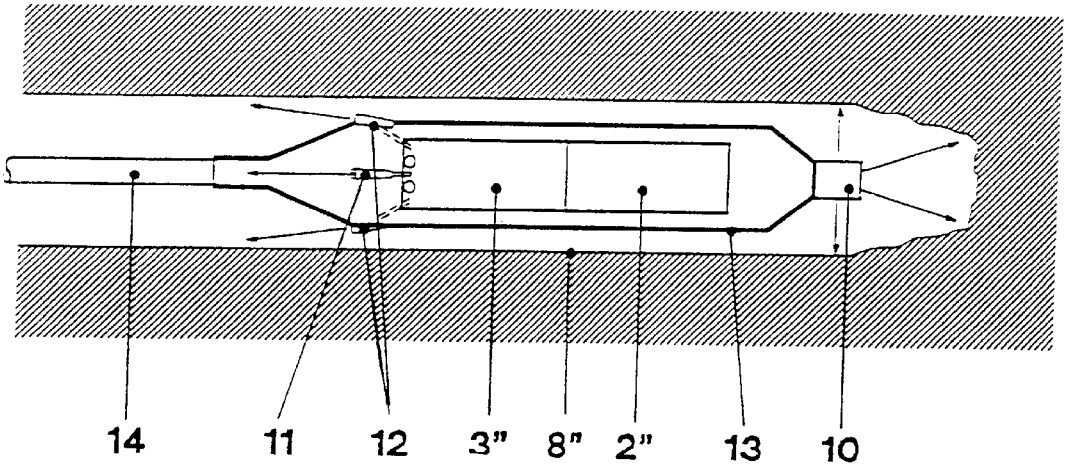
FIG. 3 shows the concept applied to pure fluid jet drilling where the drill string is a flexible hose, or a flexible joint exists between the drill string and the down-hole assembly. In this case the direction in which the module is directed and erodes a pathway is controlled by thruster jets.

FIG. 3 depicts the embodiment of a system where the bottom hole assembly 13 is fixed to the end of a flexible hose or drill string, or is connected to a conventional drill string by a flexible coupling 14'. Here, the main cutting is accomplished by the rotating nozzle 10 which cuts the formation to form the borehole 8". The direction in which the system cuts is controlled by tilting the entire drilling module 13 and switching on or off the rearward facing jets 11 and 12. These jets would typically operate in two planes to adjust the direction to which the tool is directed. These jets could also be placed at other positions along the bottom hole assembly 13 to change its orientation. The control for this operation comes from the geosteering module 2" that controls the switching module 3" which, in turn, controls the jets. The switching module 3" preferentially takes the form of two sets of the electro-fluidic control apparatus shown in FIG. 4, with or without the mechanical valve shown in FIG. 5 and the jet nozzles shown in FIG. 6.

Figure 4:
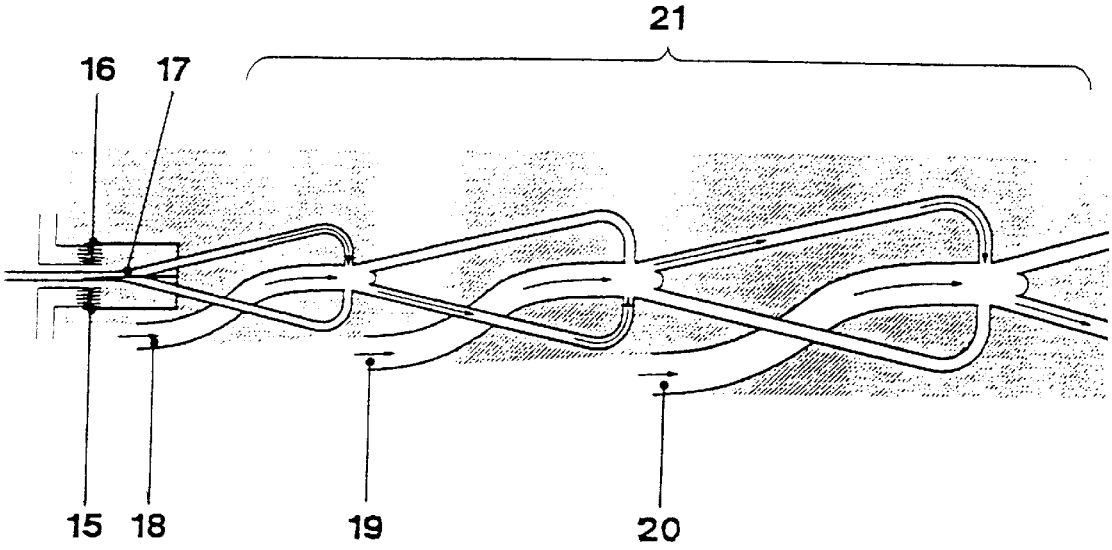
FIG. 4 shows the heart of an electro-fluidics control circuit that can be used to switch the jets.

FIG. 4 illustrates the preferred embodiment of the electro-fluidics switching system. This fluid switching system consists of an electromagnetically controlled bi-stable flow diverter 15, 16 and 17. By pulsing one electromagnet 15, the flexible magnetically susceptible reed 17 is drawn to the electromagnet 15, thus obturating the lower fluid control passage and causing the control flow which enters at the left of the figure to be diverted into the upper control fluid passage. Pulsing the other electromagnet 16 causes the reed 17 to be drawn up and the flow switched to the lower control fluid passage. This control signal can be amplified by means of a cascade of fluidic amplifiers 21 shown here as, but not restricted to being, wall attachment turbulent flow amplifiers. Each of the stages has respective inlets 19 and 20 to entrain more of the drilling fluid flow. Such an amplifier system may lead to increased switched outlet power by orders of magnitude. The outlet may be switched directly to nozzles as shown in FIG. 6, or through a valve as shown in FIG. 5, and then out to the nozzles shown in FIG. 6.

Figure 5:
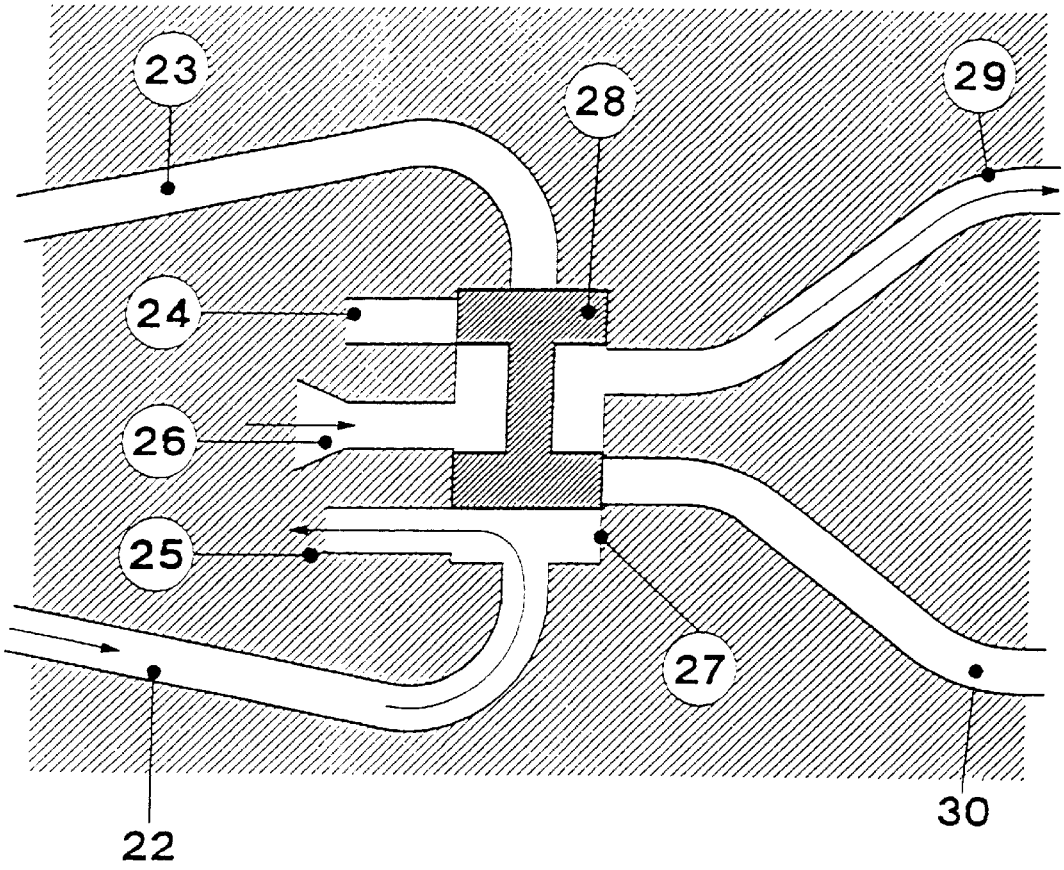
FIG. 5 shows a spool type valve suitable for fluidics control that would switch far higher pressure differentials than would the fluidics system alone.

FIG. 5 shows a mechanical valve that can be used to convert the power of the fluidics circuit to switch a high pressure medium to the fluid jets. The mechanical valve assembly consists of inlet passages 22 and 23 from which switched fluid can bear against a spool 28 which runs in a cylindrical chamber 27 that is part of the valve body. The control outlet ports 24 and 25 allow control fluid to be passed back into a lower pressure segment of the drilling module 13 or drill string 1. Fluid is then taken from inside the drill string 1 or drilling module 13 into a duct 26 and redirected into outlet passages 29 or 30. The flow through the outlet passages 29 or 30 can then be passed through the outlet nozzles 31 or 32 shown in FIG. 6 to either preferentially erode formation material ahead of the drill bit or to orient the drilling module 13. In the state of the valve shown in FIG. 5, the inflow is through passage 22 and out through control outlet port 25. The spool is shown raised, closing off the flow to outlet port 30 while allowing fluid flow to be taken from the duct 26 inside the string 1 or drilling module 13 and then to the outlet port 29. The spool 28 need not completely close the fluid communication from inlet passage 23 to the control outlet port 24. In the opposite mode, the spool 28 need not totally close the fluid communication from ports 22 to 25. For purposes of clarity, the spool valve is shown with inlets and outlets on different sides. In fact, the valve can be constructed in a totally axi-symmetric manner so that no side forces exist between the spool 28 and the cylindrical chamber 27. This feature enables the spool 28 to move freely and more quickly than would otherwise be the case.

Figure 6:
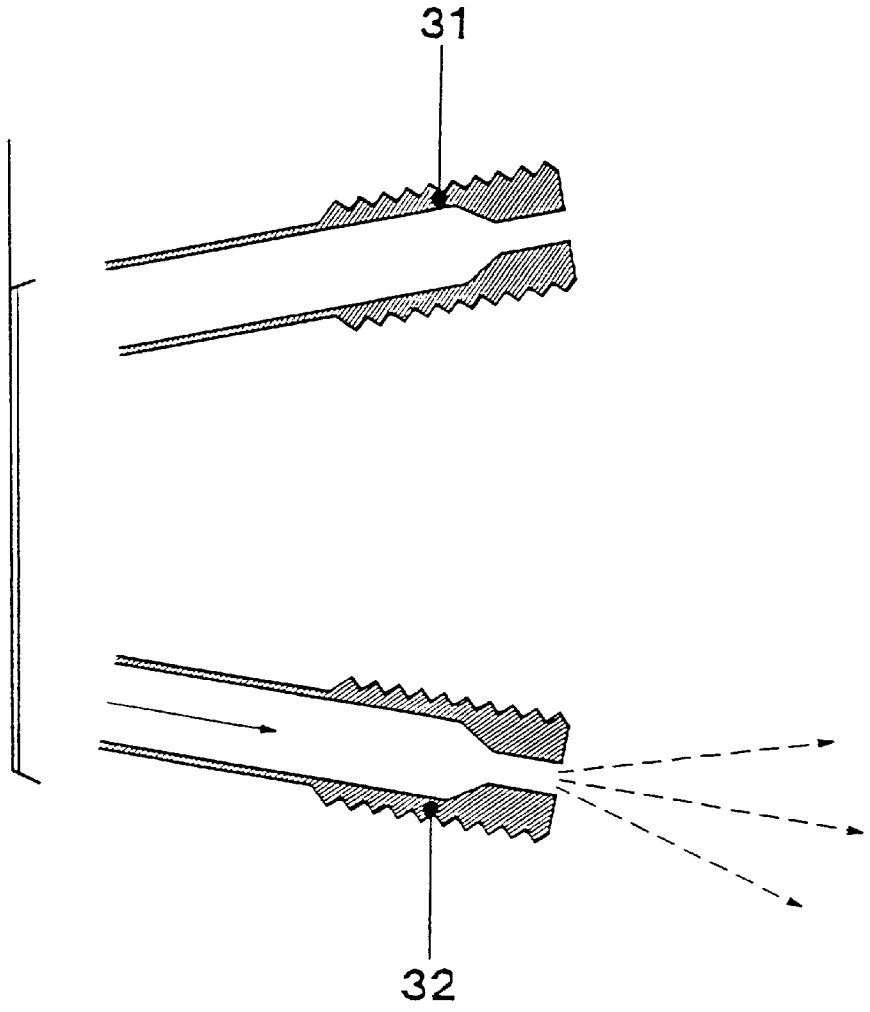
FIG. 6 shows a pair of directional control fluid jet nozzles which can be either connected directly to the fluidics control circuit shown in FIG. 4, or alternatively to the spool valve shown in FIG. 5.

FIG. 6 illustrates two nozzles 31 and 32 which would convey the fluid either from the switching circuit shown in FIG. 4 or via the valve shown in FIG. 5. Switching fluid from one nozzle to the other will either cause erosion of the borehole 8 in a preferred direction, or the tilting of the drilling module 13 so that it drills in a preferred direction.

Figure 7:
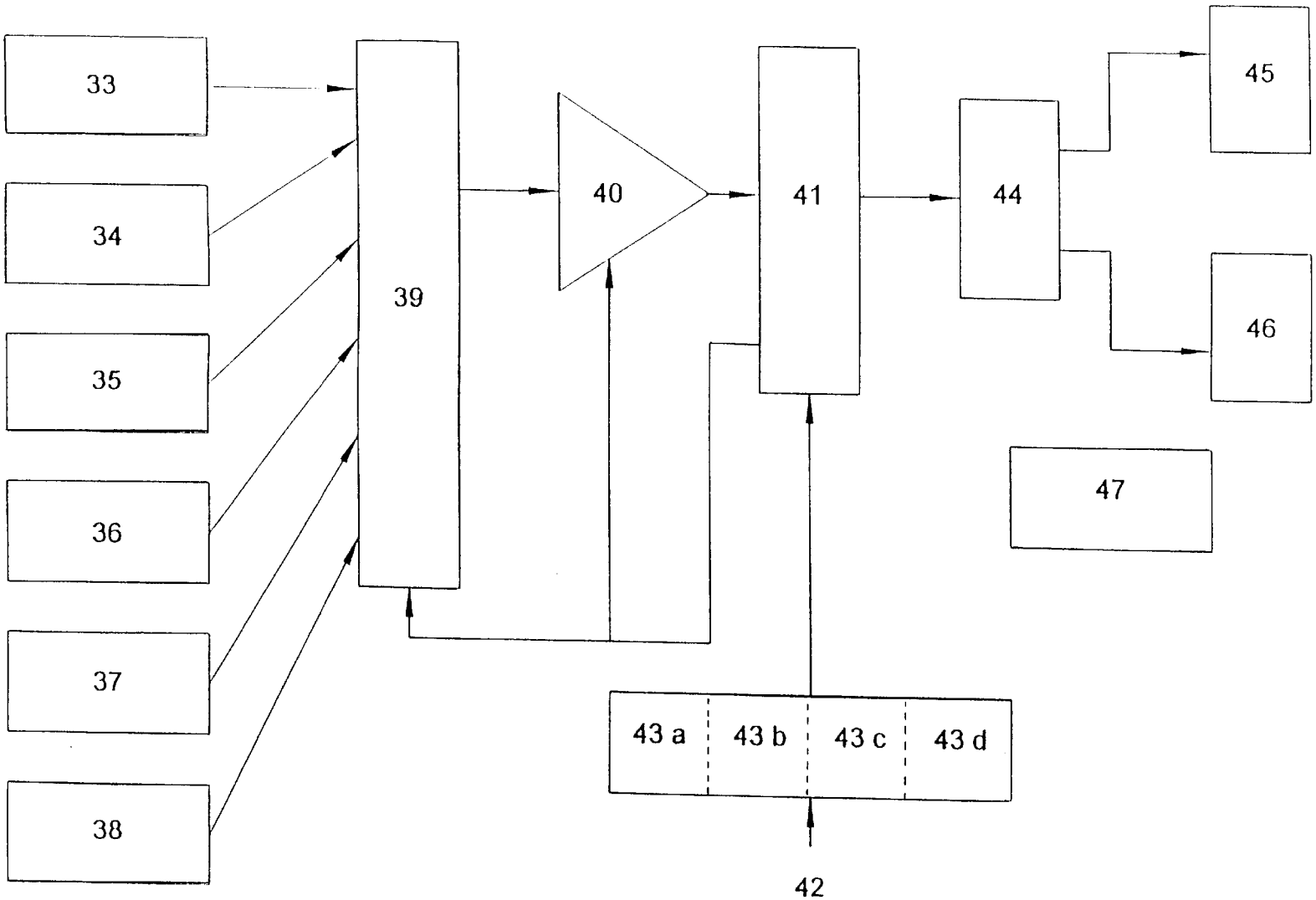
FIG. 7 is a block diagram of the electronic hardware and software that could be used in the control module.

FIG. 7 shows a block diagram of the geosteering module 2. This module 2 contains directional measurement equipment that may typically consist of a triaxial flux gate magnetometer 33, triaxial accelerometer or inclinometers 34 and various geophysical sensors 35 that may include gamma and density measurement equipment. Also included in the module 2 is a sensor 36 to determine the tool face angle while the drill string is rotated and record the total measured depth of the borehole. In nonrotating systems, the tool face angle can be readily determined from the magnetometer and accelerometers, while in the rotating case one preferred form of tool face angle measurement is by measuring the output of a coil placed therein, and perpendicularly aligned to the down-hole assembly. The sinusoidal pulses produced as the coil cuts the earth's magnetic field include information that defines the tool face angle. The preferred means for supplying the measured depth of the borehole from surface to the geosteering module 2 is by causing a momentary drop (or rise) in drilling fluid pressure at certain MD values. This can be sensed by the use of a pressure transducer 37 that forms a part of the geosteering system. The geosteering module 2 may also contain a torque, thrust or bending moment sensor 38 that enables the strata type to be determined and in addition will permit the detection of whether drilling is taking place at an intersection between hard and soft strata. In the latter case the drill rod will tend to deflect away from the hard strata, thus indicating the presence thereof. These analogue inputs will be subject to suitable signal conditioning and processed by analogue to digital converter(s) 40 directly, or via a multiplexer 39 controlled by a microprocessor 41. The microprocessor 41 is controlled by software stored in a memory 42. The memory 42 stores software routines and data 43*a* for defining the desired borehole path, software routines 43*b* to determine the actual borehole path from geophysical sensor input and information received concerning drilled depth, software routines 43*c* for determining the angular position of the drill bit, and software routines 43*d* for controlling the fluid switching to correct actual borehole path to correspond to the desired borehole path. The microprocessor 41 controls the outgoing telemetry system 45 and switch 46 for fluid control of direction via a suitable interface 44. The system is powered by a suitable power supply 47 that may comprise batteries, an alternator, generator or other devices.

Figure 8:
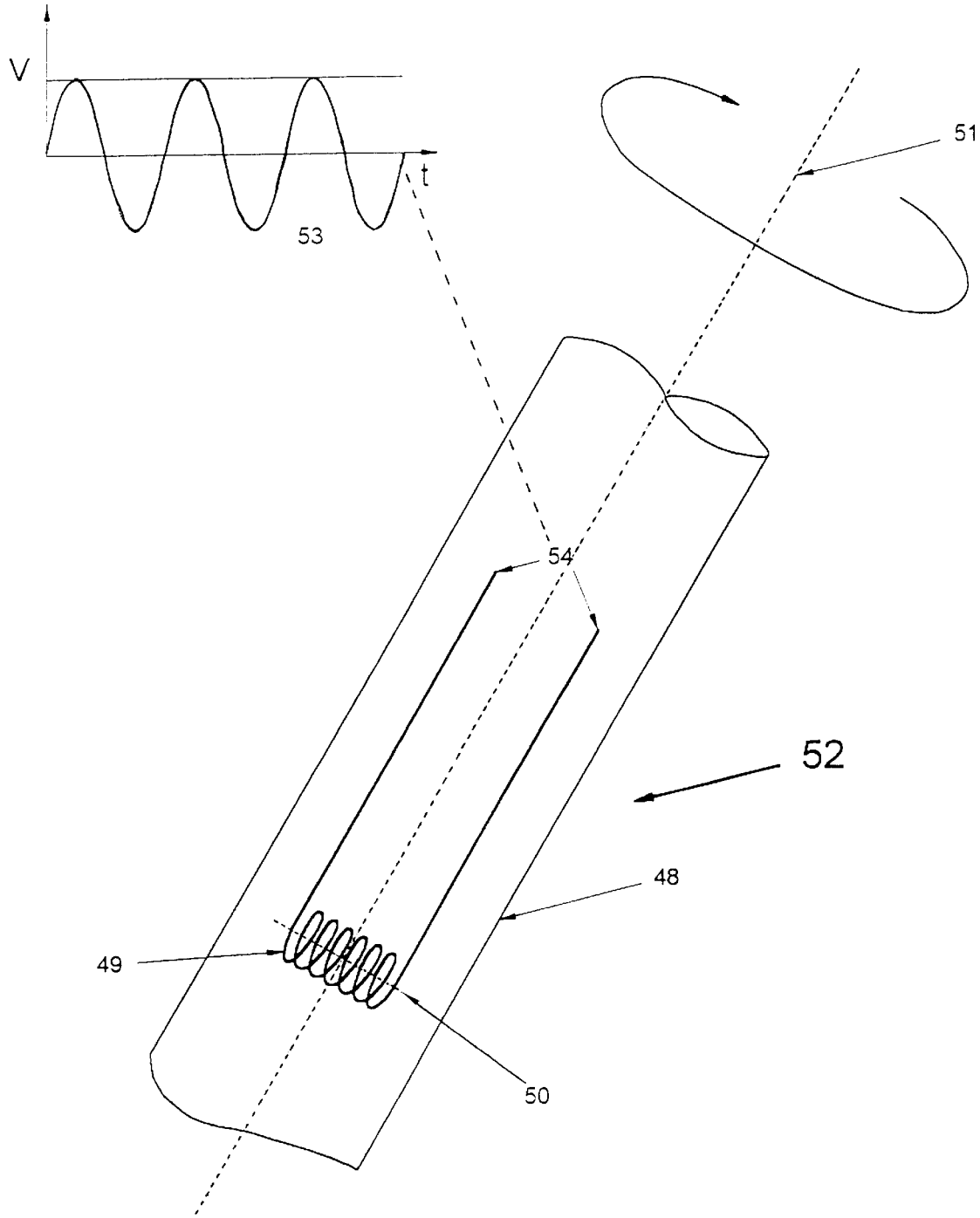
FIG. 8 shows an electromagnetic coil contained within a rotating bottom hole assembly, and the output of that coil with rotation as it is excited by the earth's magnetic field.

FIG. 8 shows a rotating portion of a bottom hole assembly 48 containing an electromagnetic coil 49 aligned so that the axis 50 of the coil 49 is not aligned with the axis 51 of rotation of the bottom hole assembly 48. The axis 50 of the coil 49 is preferably oriented at right angles to the axis of rotation 51. During rotation when the direction of the earth's magnetic field 52 is not aligned with the axis of rotation 51, the electrical output 53 of the coil 49 oriented from terminals 54 will follow a sinusoidal curve, the phase of which will be directly related to the component of the earth's magnetic field 52 aligned in the direction of the axis 50 of the coil 49. The phase of the electrical output 53 can be employed to define the tool face angle of the bottom hole assembly while it is rotating, given knowledge of the direction of the borehole with respect to the earth's magnetic field 52. The latter would normally be gained from the flux gate 33 and gravitational sensors contained within the bottom hole assembly for the purposes of direction measurement.

Figure 9:
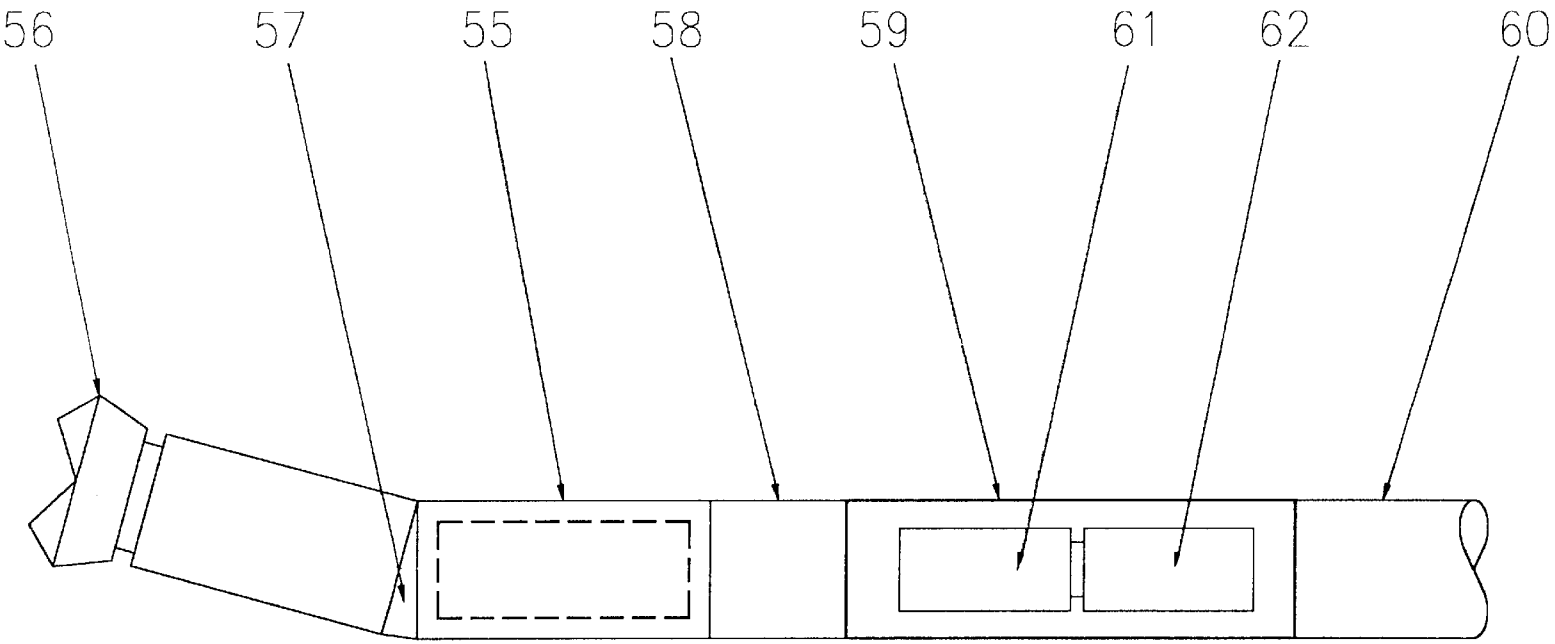
FIG. 9 depicts the concept of the invention as applied to a clutched mud motor in which the tool face angle is controlled by reactive torque.

FIG. 9 is a diagram of a mud motor 55 that drives a bit 56 though a coupling to convey torque around a bend 57. This apparatus imparts a directional drilling characteristic to the bottom hole assembly (those items physically between and including reference numerals 56 to 59). The mud motor 55 is attached to a clutch and bearing assembly 58, the uphole side of which is a part of the bottom hole assembly 59 that is directly coupled to the drill string 60. Contained within this assembly is the switching module 61 and the geosteering module 62. The clutch assembly 58 is designed to be controlled through controlled slipping or pulsed slipping by the switching module 61 so as to permit the re-orientation of the bent sub by reactive torque. The clutch assembly 58 could be replaced by a hydraulic motor designed to be powered by the drilling fluid. In this case the motor could be used as a clutch that is controlled by allowing fluid flow to bleed through it under switchable control from the switching module 61. Alternatively, the motor could be directly powered by the fluid so as to change the orientation or angle of the bend 57.

Figure 10:
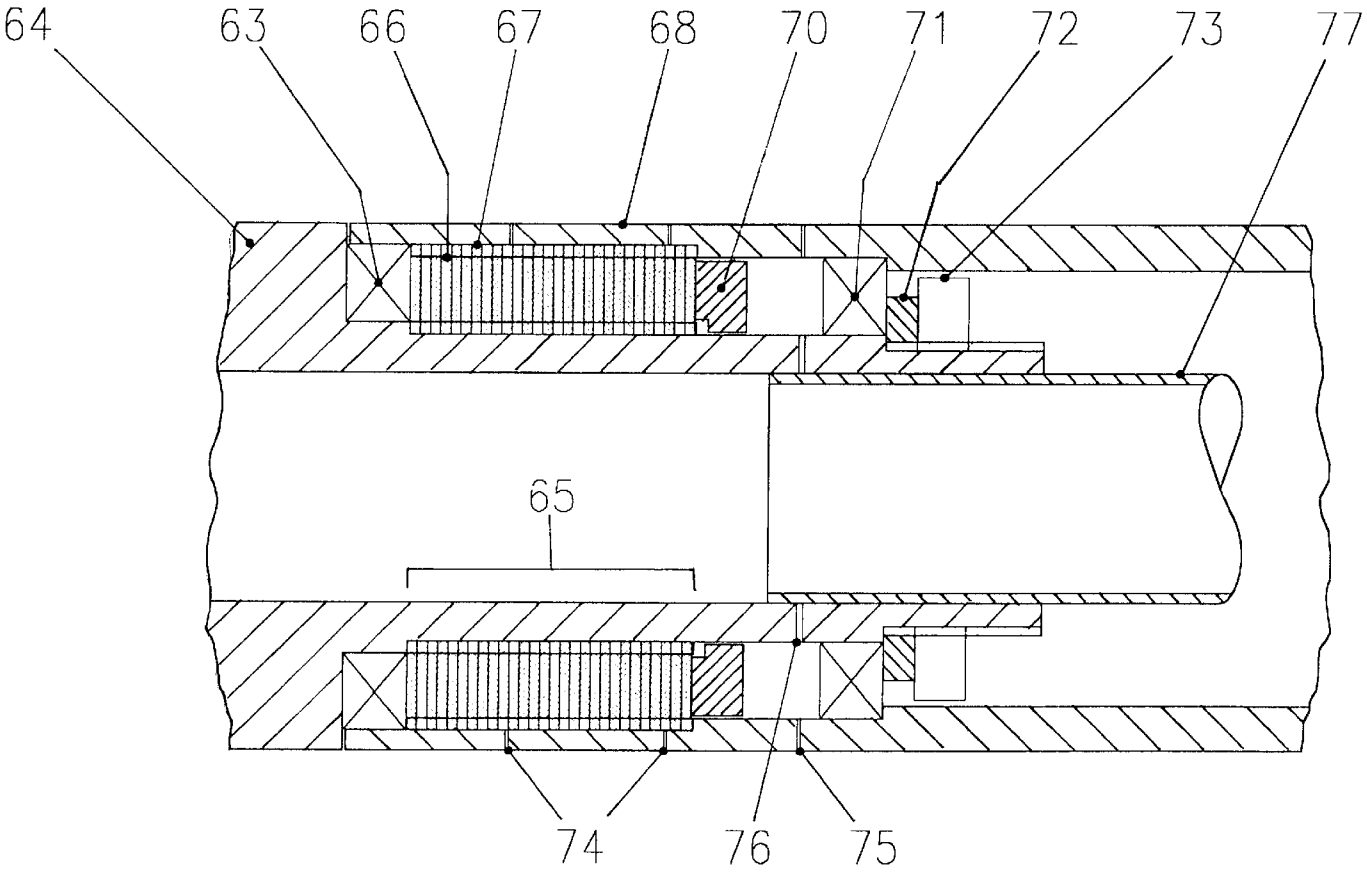
FIG. 10 shows in detail the operation of a clutch for use in controlling a mud motor.

FIG. 10 shows a preferred arrangement of the clutch assembly 58 described in FIG. 9. Here, the clutching mechanism 58 is a multi-disc clutch pack that preferably utilizes drilling fluid switched from the switching unit 61 (FIG. 9) for its control. Reference numeral 63 depicts the forward bearing/seal arrangement that absorbs thrust from a connection to the down-hole motor 59. This connection extends as a shaft 64 that is splined in the section 65 and carries with it the inner keyed discs 66 of the clutch pack. The interleaved outer keyed discs 67 of the clutch pack are set in the partially splined housing 68 which is attached to the section of the bottom hole assembly 59 described in FIG. 9. The near end section of the shaft 64 supports a ring shaped piston 70 that floats between it and the outer housing 68. The end of the shaft 64 is held in bearing 71 within the outer housing and fixed thereto by a washer 72 and nut 73. The fluid pressure in the clutch pack is maintained close to the pressure of the borehole annulus by holes 74 and by adequate fluid communication passages though the clutch pack itself. The fluid area behind the piston 70 is in communication with the borehole annular fluid pressure by means of either small holes 75 or a leaky piston seal. The fluid area behind the piston 70 is also in switchable communication by ports 76 with the drilling fluid passing though the inside of the shaft 64 en route to the down-hole destination. Whether the ports 76 are open to the drilling fluid on the inside of the shaft 64 is controlled by the position of a sleeve 77. When the clutch is locked, the sleeve 77 is withdrawn (to the right in FIG. 10) by controls from the switching module 61 (FIG. 9) and drilling fluid pressure is transmitted to the piston 70 with only a slight pressure drop due to the ports 75 which are smaller that the ports 76. The piston 70 advances and compresses the interleaved disc clutch plates 66 and 67 together, thus locking the inner shaft 64 which is connected to the down-hole motor 59 via the outer splined housing 68, which housing is connected to the upper part of the bottom hole assembly 59 (FIG. 9).

To achieve rotation of the lower part of the assembly, the sleeve 77 is axially moved so as to close the port 76, thus leading to the equalization of the pressure behind the piston 70 and that existing in the clutch pack side of the piston. In this case slipping of the clutch may occur and re-orientation of the tool face will occur. The operational position of the sleeve 77 is controlled by a piston (not shown) responding to two fluid pressure output states of the switching module 61 (FIG. 9).

From the foregoing, disclosed are methods and apparatus for the directional control in forming a borehole. A borehole is maintained in a desired path during the drilling operation by the switched action of fluid jets which are activated during only a portion of angular rotation of the drill bit to thereby preferentially erode the path of the drill bit in the desired direction. The angular position of the drill bit is determined by an electromagnetic sensor and the fluid jet activation is determined accordingly. The angular position of the drill bit itself avoids the use of correction factors that would otherwise be needed when the long drill string undergoes torsional twist, and when the drill bit angular position is determined at the surface of the drill site. As an alternative to the use of fluid jets to erode the underground formation along a preferential path, a down-hole mud motor, a clutch assembly, and a coupling for driving a bit in a bend or curved path may be employed.

Disclosed also are programmed control circuits located at the down-hole site to control the drilling of the borehole along a desired path. The programmed control circuits include a database of parameters defining the desired path to be formed by the drill bit. Numerous down-hole sensors are utilized to determine the actual spatial position of the drill bit. The programmed control circuits compare the actual drill path to the desired drill path, and if a difference is found, the fluid jets are activated during rotation of the drill bit to cause it to erode the formation in a direction toward the desired path. Preferably, the fluid jets are activated during each revolution of the drill bit, but for less than 360°, and preferably much less than 180°.

While the preferred and other embodiments of the invention have been disclosed with reference to a specific drilling arrangement, and methods of operation thereof, it is to be understood that many changes in detail may be made as a matter of engineering or design choices, without departing from the spirit and scope of the invention, as defined by the appended claims.

What is claimed is:

1. A bottom-hole assembly for controlling the direction of a path of a borehole during formation thereof, comprising:

a port in said assembly for receiving a pressurized fluid;

a rotating fluid carrying mechanism operable for changing the direction of the drilling path, an electrically operated fluid switch for selectively controlling coupling of said pressurized fluid to said fluid carrying mechanism to change the path of the borehole;

one or more sensors for sensing a rotational position as said bottom-hole assembly rotates; and a programmed processor responsive to said rotational sensor for controlling activation of said electrical fluid switch at different times during each rotation of said bottom-hole assembly so that the pressurized fluid can be switched to said mechanism to control the direction of the drilling path.

2. An assembly according to claim 1, wherein said processor is programmed with a profile of a desired path to be taken to form said borehole, and programmed to compare the parameters of an actual location with the profile of the desired path, and programmed to actuate said fluid switch based on a difference found in said comparison.

3. An assembly according to claim 1, wherein said fluid carrying mechanism comprises at least one nozzle for providing a jet of said pressurized fluid.

4. An assembly according to claim 1, wherein said electrically operated fluid switch selectively controls at least one nozzle which controls the path direction by exerting a force in a direction opposite to a direction of an intended path.

5. An assembly according to claim 4, wherein said electrically operated fluid switch is included in a bi-stable fluidic switching system that has plural stages for successively increasing the fluid power in the bottom-hole assembly.

6. An assembly according to claim 1, further including a fluidic amplifier means coupled to said fluid carrying mechanism for increasing a quantity of fluid passing thereto.

7. An assembly according to claim 6, including at least a pair of nozzles, and a bi-stable fluidic switching system having a primary fluid duct controlled by a pair of inlet fluid channels, each fluid channel for controlling the flow of fluid to a respective said nozzle.

8. An assembly according to claim 7, wherein said bi-stable fluidic switching system includes a spool valve having two stable positions controlled by respective channels of the fluidic amplifier.

9. An assembly according to claim 1, wherein said fluid switch comprises an electromagnetic fluid switch to divert fluid flow between at least two channels by electromagnetically displacing an obturating device to close one channel at a time.

10. An assembly according to claim 1, wherein said fluid carrying mechanism comprises a mechanical assembly for changing by fluid controls an angular build characteristic of the bottom-hole assembly including a down-hole fluid operated motor.

11. An assembly according to claim 1, wherein said fluid carrying mechanism comprises a clutch which selectively rotationally disengages a lower part of the bottom-hole assembly that includes a down-hole motor and a bent sub, from the upper part and which permits reactive torque to change a tool face angle of said lower part of the bottom hole assembly so as to effect controllable change of the tool face angle and hence a preferred direction of drilling.

12. An assembly according to claim 1, further including a device to detect an angular position of a rotating bottom hole assembly utilizing an electrical output of an electromagnetic coil attached to and rotating with the bottom hole assembly and excited by the magnetic field of the earth.

13. A method of controlling the path of an underground borehole during formation thereof, comprising the steps of:

advancing in the earth a pressurized fluid conveyor with a bottom-hole assembly incorporating at least one fluid jet nozzle, an electrical fluid switch and a programmed processor for controlling said electrical fluid switch, and a positional sensor for sensing an arcuate position during rotation of said bottom-hole assembly;

providing arcuate position data to said programmed processor;

causing electrical signals to be generated by said processor in response to said arcuate position data, so that said electrical fluid switch is both electrically activated and deactivated at least once for each revolution of said bottom-hole assembly; and controlling said electrical fluid switch for switchably coupling the pressurized fluid from said fluid conveyor to said fluid jet nozzle by said processor to control the direction of the path of the borehole.

14. The method according to claim 13, wherein at least one fluid jet nozzle is utilized to form the borehole by directional erosion, and a different fluid jet nozzle is selectively switched for directional control.

15. The method according to claim 13, comprising the steps of:

coupling a fluid-controlled clutch to a mechanism for controlling an angular build rate of the bottom-hole assembly; and using a fluid switching system to switchably control said clutch to adjust the angular build characteristics of the bottom-hole assembly.

16. The method according to claim 13, further including increasing the fluid power available to the bottom-hole assembly by using a down-hole fluidic amplifier.

17. The method according to claim 16, further including using a spool valve driven by the fluidic amplifier to divert fluid flow to actuate adjustments in the angular build characteristics of the bottom-hole assembly.

18. The method according to claim 13, including using a fluidic amplifier switching system having multiple stages.

19. The method of claim 13, further including transmitting information from surface located equipment to the bottom-hole assembly by utilizing negative or positive fluid pulses.

20. The method of claim 13, further including obtaining information from angular position sensors contained within the bottom-hole assembly and combining said information with information transmitted from a borehole collar to the bottom-hole assembly to thereby compute the physical location of the bottom hole assembly.

21. The method according to claim 12, wherein the information from the borehole collar is transmitted downhole by means of pulses.

* * * * *